US006783389B1

(12) United States Patent
Lee

(10) Patent No.: US 6,783,389 B1
(45) Date of Patent: Aug. 31, 2004

(54) CABLE CONNECTOR ASSEMBLY HAVING DETECTING CONTACT

(75) Inventor: George Lee, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/642,080

(22) Filed: Aug. 14, 2003

(51) Int. Cl.[7] ..... H01R 24/00
(52) U.S. Cl. ..... 439/489; 439/447
(58) Field of Search ..... 439/489, 490, 439/447, 638, 650, 682

(56) References Cited

U.S. PATENT DOCUMENTS 5,509,827 A * 4/1996 Huppenthal et al. ..... 439/638
5,700,157 A 12/1997 Chung
6,361,357 B1 * 3/2002 Stillwell et al. ..... 439/490
6,409,530 B1 6/2002 Zhao et al.
6,431,904 B1 * 8/2002 Berelsman ..... 439/447
6,457,993 B1 10/2002 Espenshade

* cited by examiner

*Primary Examiner*—Renee Luebke

(57) ABSTRACT

A cable connector assembly (1) includes an insulative housing (2), a number of conductive contacts (3), a number of conductive wires (5) respectively soldered with the contacts, a spacer (4) assembled to the housing and an insulative cover (7) overmolded on the housing. The housing includes a plurality of passageways (25) and an L-shaped receiving space (20) communicating with the passageways (25). The contacts are respectively received in the passageways and include a number of first contacts (3*a*) for signal transmission to a complementary connector, a pair of second contacts (3*b*) functioning as grounding contacts and a third contact (3*c*) electrically connecting with a corresponding detecting terminal of the complementary connector for indicating an engaging status between the cable connector assembly and the complementary connector.

9 Claims, 8 Drawing Sheets

CABLE CONNECTOR ASSEMBLY HAVING DETECTING CONTACT

BACKGROUND OF THE INVENTION

1. Field of the Invention

The present invention generally relates to a cable connector assembly, and more particularly to a cable connector assembly which can indicate an engaging status between the assembly and a complementary connector.

2. Description of Related Art

Cable connector assemblies are widely used for signal or power transmission between personal computers and peripheral equipments, such as monitor and scanner. When the electrical connection between a connector and a complementary connector becomes faulty, there is a need to identify the fault duly and solve the problem immediately. Thus, a connector providing a visual indication, such as a Light Emitting Diode (LED), on faulty information regarding the electrical connection between the connector and the complementary connector is required.

U.S. Pat. No. 6,457,993, issued to Espenshade, discloses a modular jack comprising a pair of LEDs. The modular jack and the pair of LEDs are all mounted to a printed circuit board (PCB) and electrically connect to each other through an electrical circuit arranged on the PCB. When a complementary connector engages with the modular jack, the LEDs will on or off to indicate the engaging status between the modular jack and the complementary connector. However, with the development of computer, the size of a PCB becomes smaller, while electronic components mounted to the PCB become more. In such a condition, the module jack and the LEDs all mounted to the PCB inevitably complex the circuits arranged on the PCB, which is out of current trend.

Hence, a connector having a detecting contact for indicating the engaging status between a connector and a complementary connector is highly desired.

SUMMARY OF THE INVENTION

An object of the present invention is to provide a cable connector assembly having a detecting contact for engaging with a corresponding detecting terminal of a complementary connector to indicate the engaging status between the cable connector assembly and the complementary connector.

Another object of the present invention is to provide a cable connector assembly having a detecting contact for simplifying circuits arranged on a printed circuit board.

In order to achieve the objects set forth, a cable connector assembly in accordance with the present invention comprises an insulative housing, a plurality of conductive contacts, a plurality of conductive wires respectively soldered with the contacts, a spacer assembled to the housing and an insulative cover partially enclosing the housing. The insulative housing defines a plurality of passageways extending therethrough and an L-shaped receiving space communicating with the passageways. The contacts are respectively received in the passageways and comprise a plurality of first contacts for signal transmission to a complementary connector, a pair of second contacts functioning as grounding contacts and a third contact electrically connecting with a corresponding detecting terminal of the complementary connector.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiment of the present invention.

Figure 1:
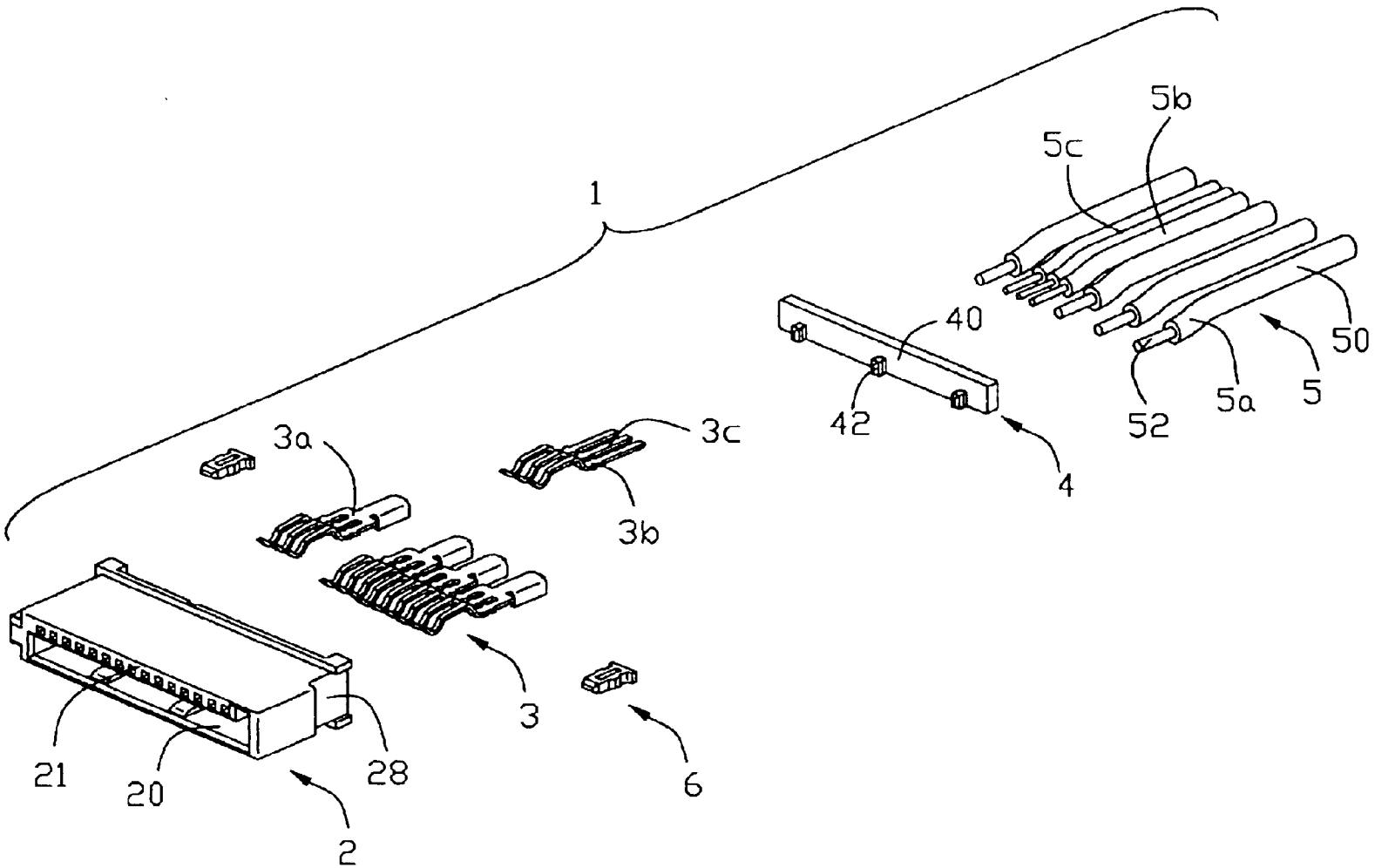
FIG. 1 is an exploded, perspective view of a cable connector assembly in accordance with the present invention.
Figure 2:
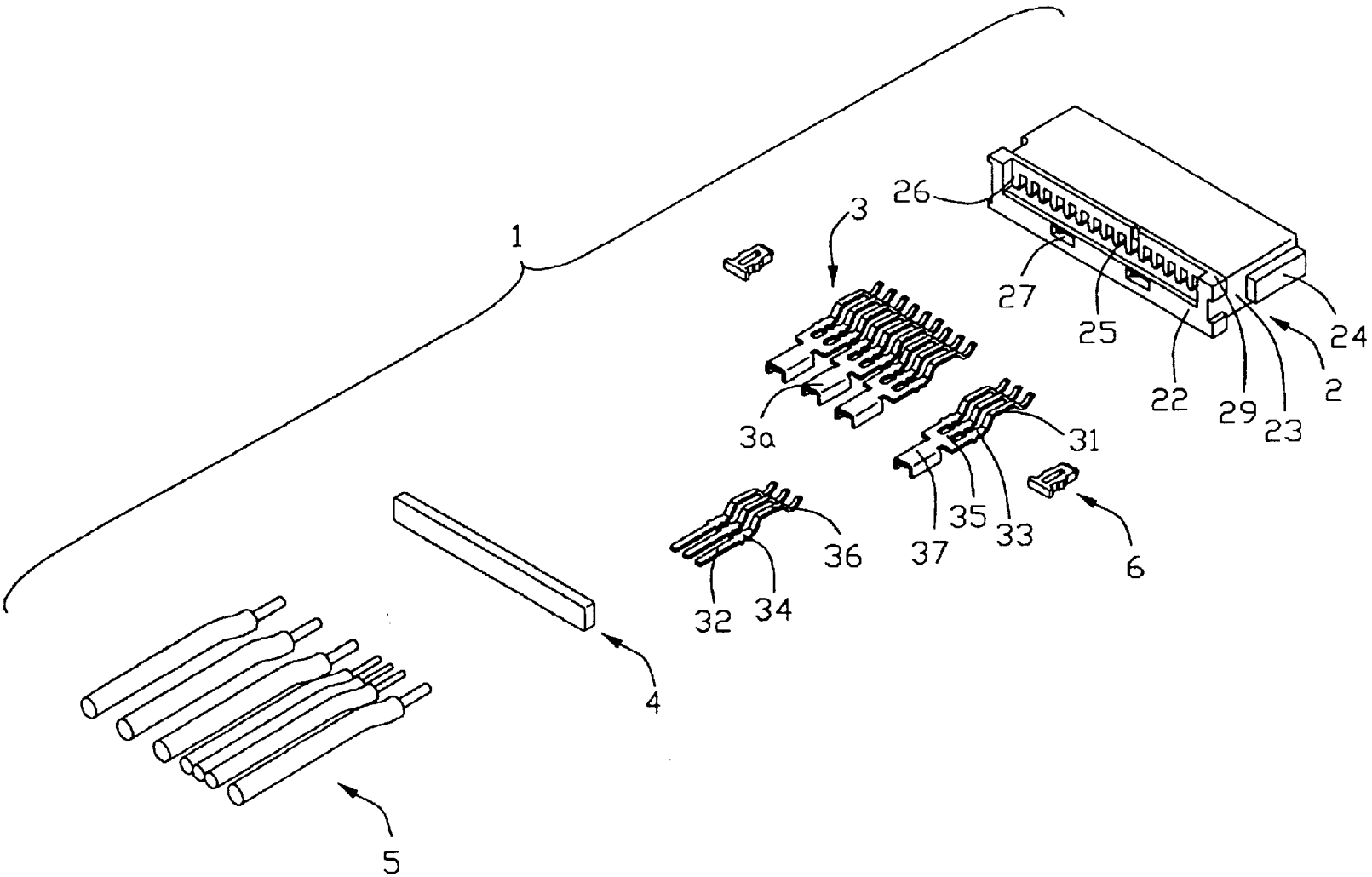
FIG. 2 is a view similar to FIG. 1, but taken from a different aspect.

Referring to FIG. 1 and FIG. 2, a cable connector assembly 1 in accordance with the present invention comprises an insulative housing 2, a plurality of conductive contacts 3, a spacer 4, a plurality of conductive wires 5, and a pair of blocks 6.

Continuing to FIG. 1 and FIG. 2, the insulative housing 2 is substantially elongated. The insulative housing 2 comprises a mating face 21 disposed at a front end thereof along a longitudinal direction, a rear face 22 formed at a rear end of the insulative housing 2 and opposite to the mating face 21, and a pair of lateral faces 23 disposed on opposite sides of the insulative housing 2 and extending between the mating face 21 and the rear face 22. A guiding member 24 projects outwardly from one lateral face 23 of the housing 2 and is coplanar with the mating face 21 for properly guiding insertion of a complementary connector (not shown). An L-shaped receiving space 20 extends rearwardly from the mating face 21 of the insulative housing 2. A plurality of contact passages 25 protrudes from the rear face 22 toward the mating face 21 and communicates with the receiving space 20. A cutout 28 is defined in the rear end of the insulative housing 2 and recesses from the other lateral face 23. A pair of ribs 29 is provided on opposite upper and lower faces (not labeled) of the insulative housing 2. Opposite ends of each rib 29 respectively extend beyond one lateral face 23 to be coplanar with the guiding member 24 and a bottom face of the cutout 28 to be coplanar with the other lateral face 23 for decreasing a transverse size of the housing 2. A groove 26 is recessed from the rear face 22 of the housing 2 and communicates with the passages 25. A pair of keys (not labeled) is formed in the receiving space 20 for facilitating engagement between the conductive contacts 3 and corresponding contacts of a complementary connector. However, the pair of keys makes extractions of molding cores of the insulative housing 2 relatively difficult. Thus, a pair of recesses 27 functioning as auxiliary craft passageways recesses forwardly from the rear face 22 and is located below the groove 26 for molding the keys in the receiving space 20 conveniently and uniformly.

The conductive contacts 3 comprises four groups of first contact 3*a*, a pair of second contacts 3*b* and a third contact 3*c* sandwiched by the pair of second contacts 3*b*. The first contact 3*a* is of a fork shape and comprises a base section 35, a U-shaped tail section 37 extending from the base section 35, three mating sections 31, and three retention sections 33 extending oppositely from the base section 35 and respectively connecting with the mating sections 31. The second contact 3*b* is a grounding contact and the third contact 3*c* is a detecting contact. The second and the third contacts 3*b*, 3*c* have the same structure and each comprise a retention portion 34, a mating portion 36 and a tail portion 32 respectively extending from the retention portion 34.

Continuing with FIGS. 1–2, the spacer 4 is a rectangular block and comprises a body 40 and a plurality of protrusions 42 extending forwardly from a front face thereof.

The conductive wires 5 comprise a plurality of first wires 5*a*, a pair of second wires 5*b* and a third wire 5*c*. The wires 5 have the same structure and are different in size from one another. Each wire 5 comprises an insulative jacket 50 and an insulated, conductive core 52 partially exposed outside the insulative jacket 50.

Figure 3:
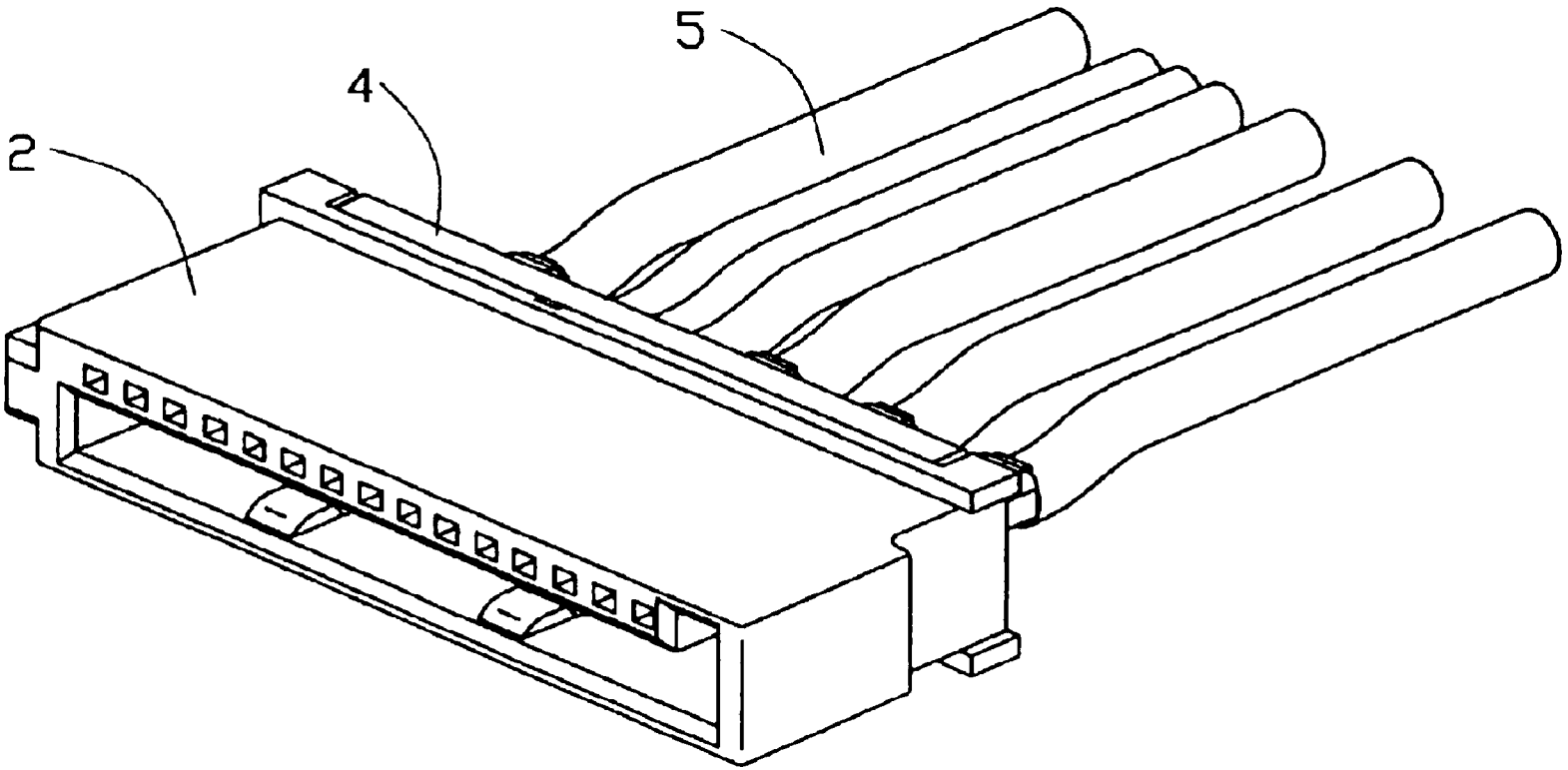
FIG. 3 is an assembled view of FIG. 1.
Figure 4:
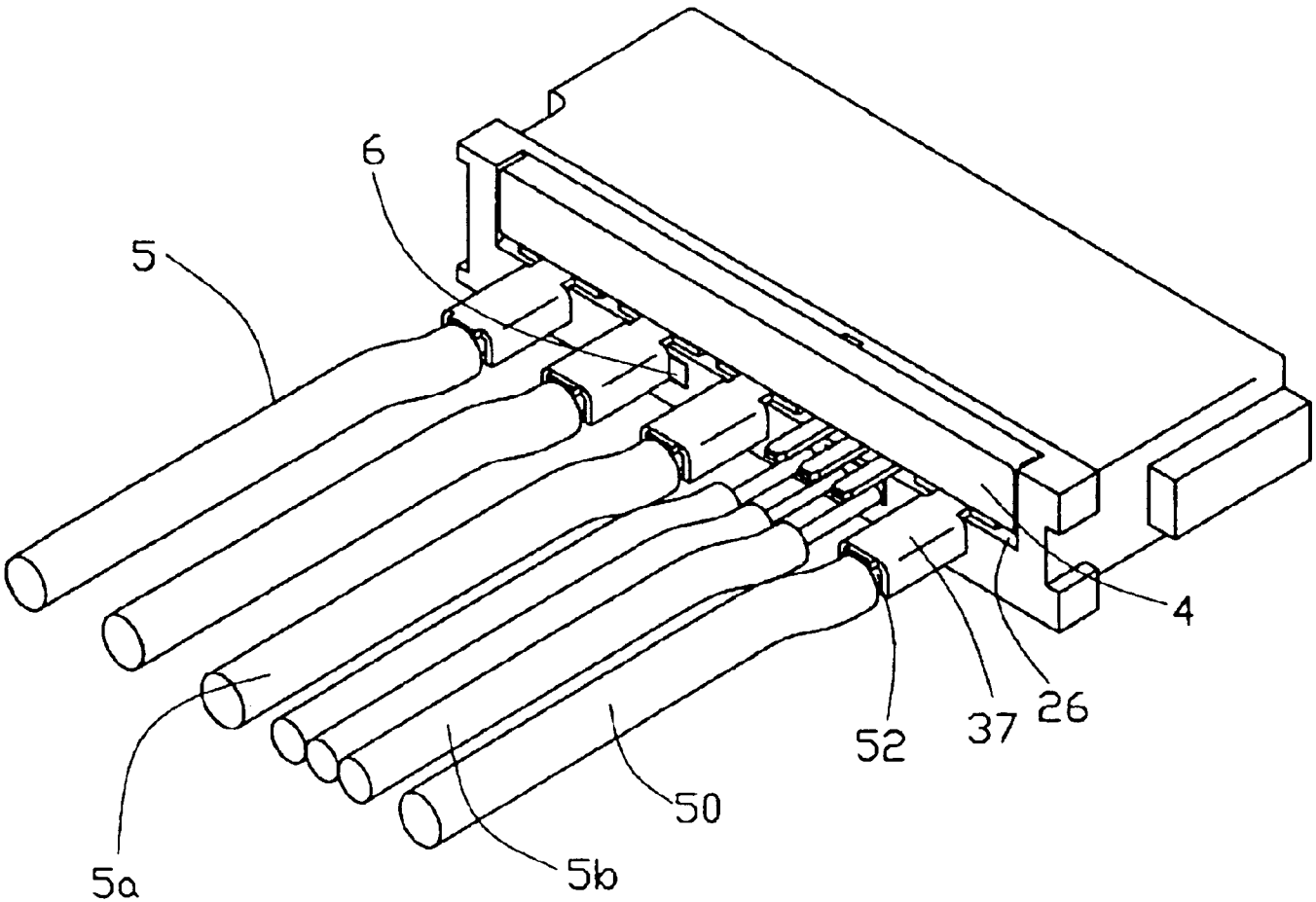
FIG. 4 is a view similar to FIG. 3, but taken from a different aspect.
Figure 5:
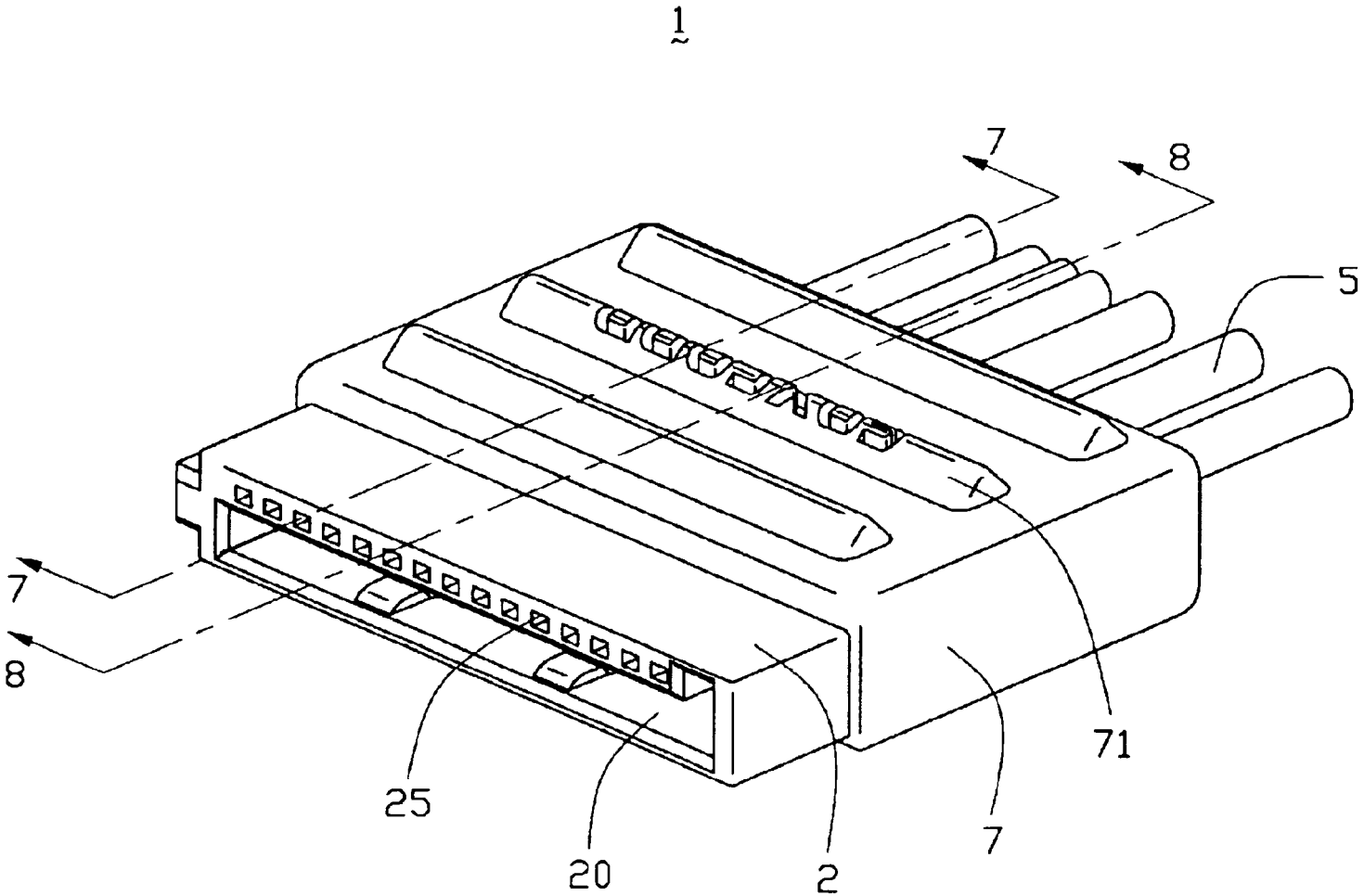
FIG. 5 is a perspective view of the cable connector assembly in accordance with the present invention.
Figure 6:
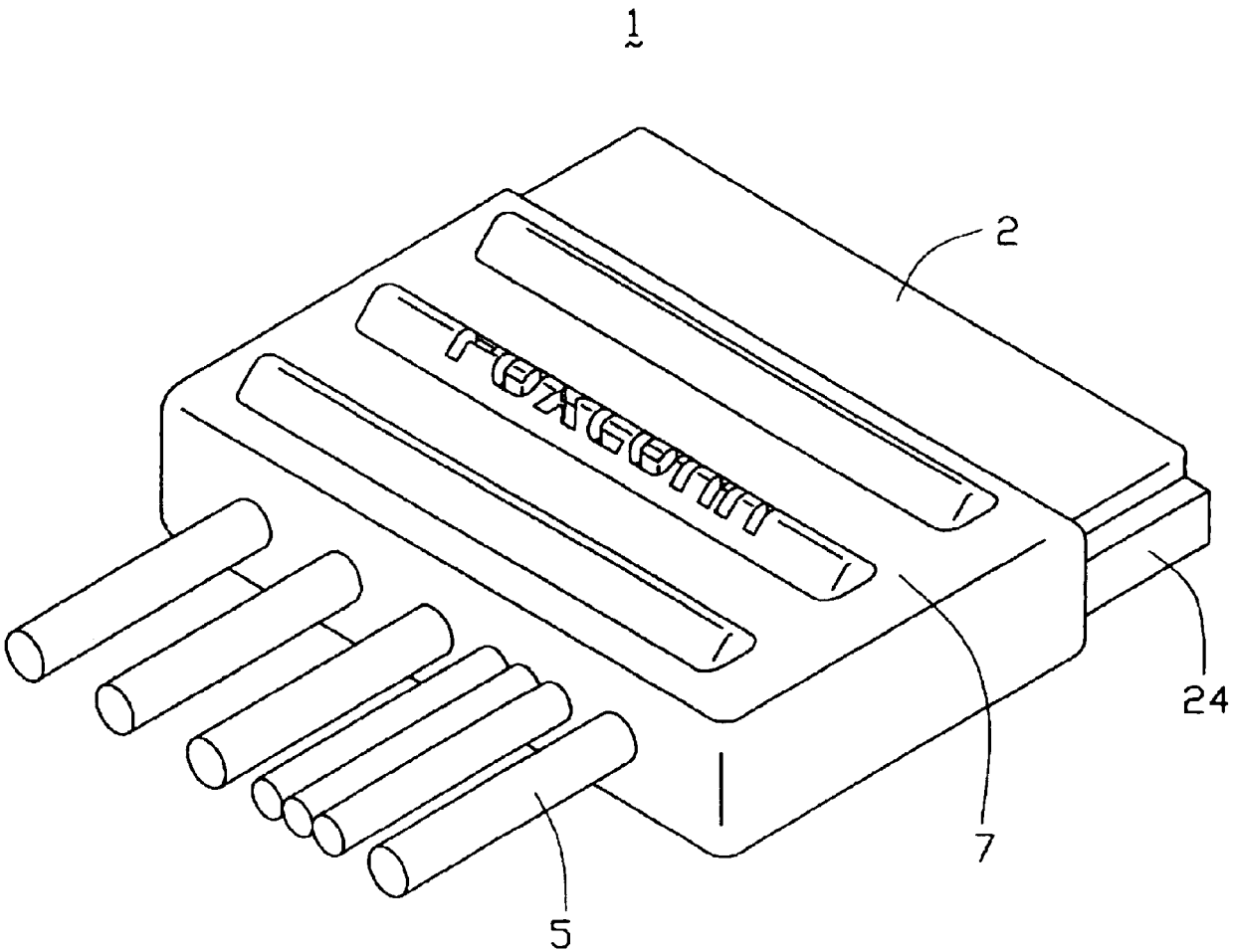
FIG. 6 is a view similar to FIG. 5, but taken from a different aspect.
Figure 7:
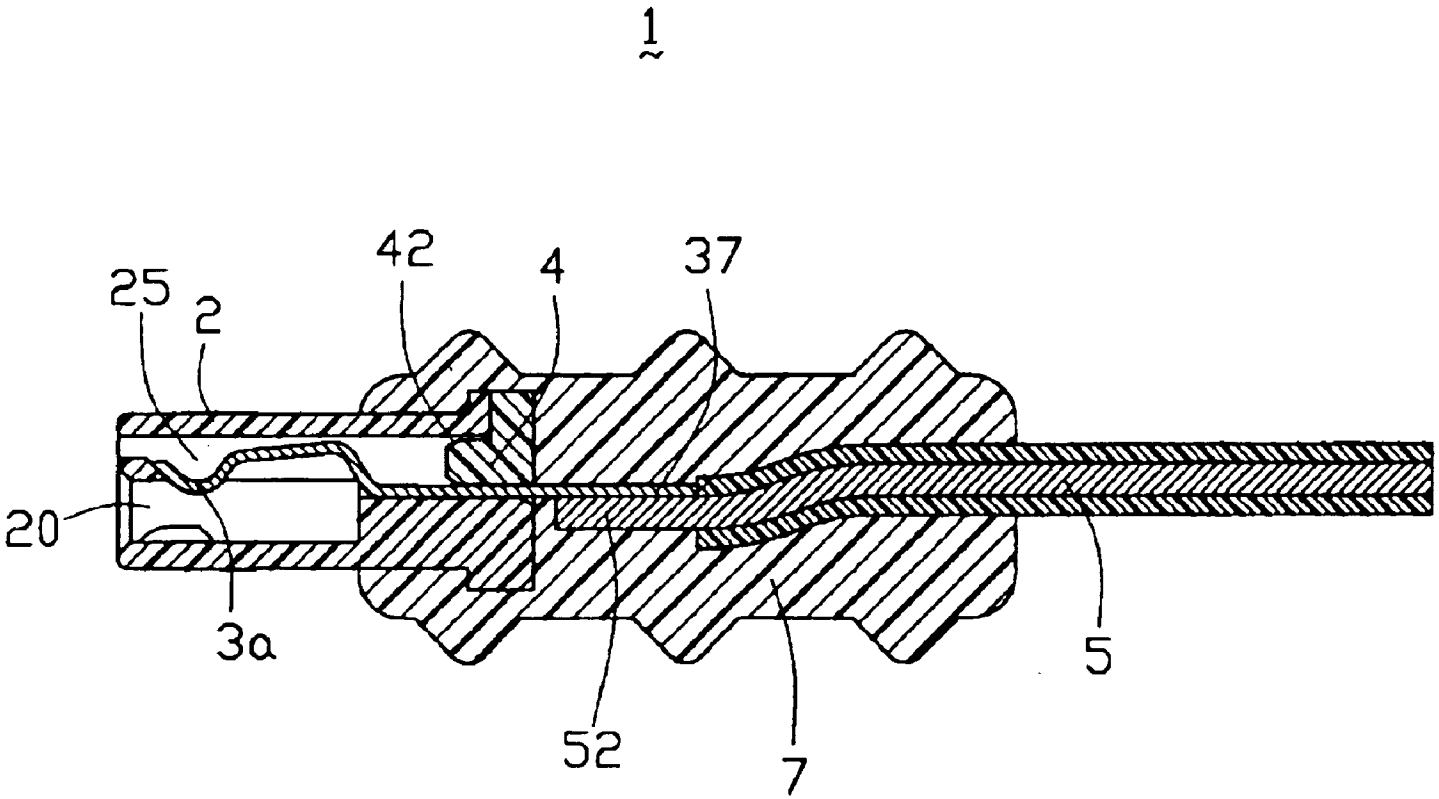
FIG. 7 is a cross-sectional view of the cable connector assembly of FIG. 5 taken along line 7—7.
Figure 8:
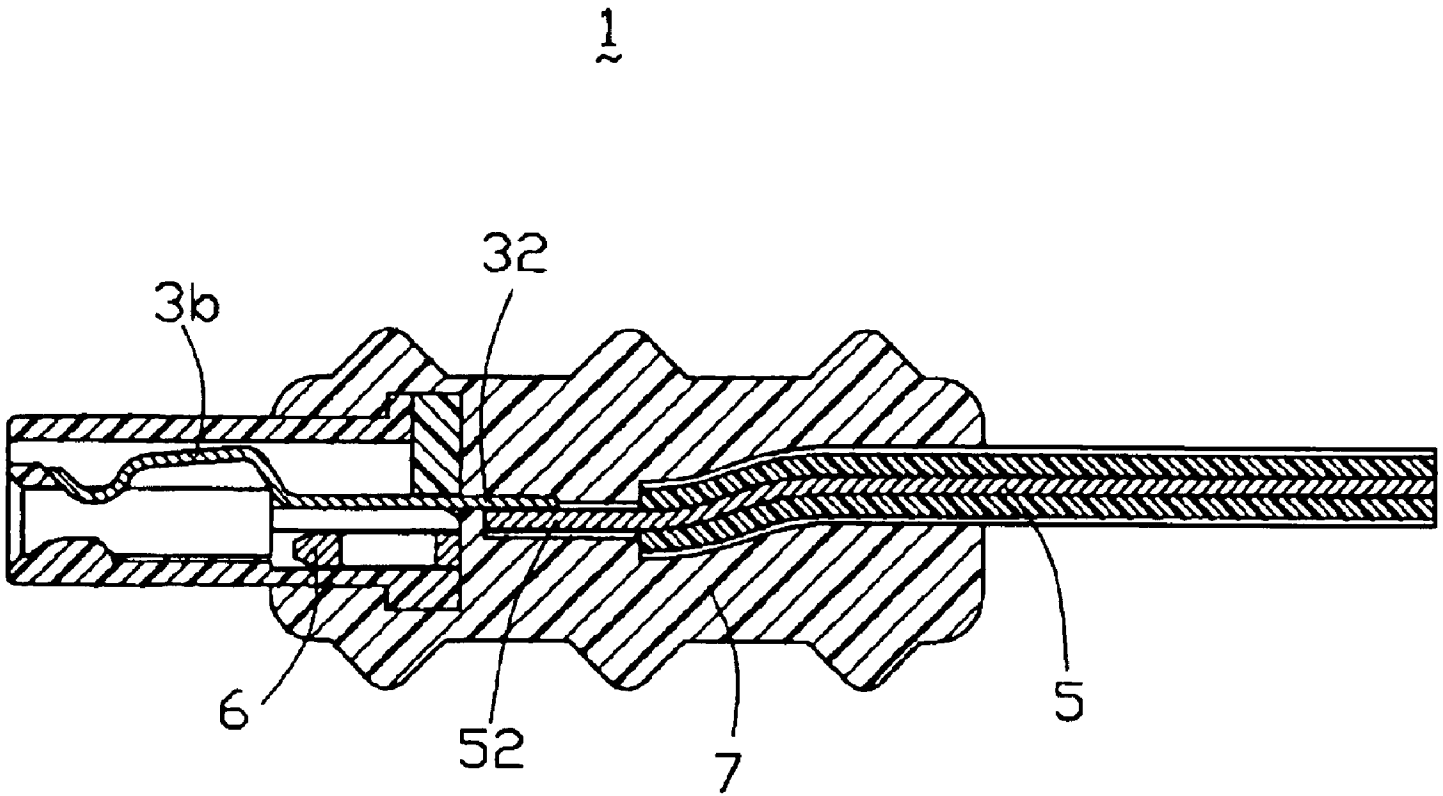
FIG. 8 is a cross-sectional view of the cable connector assembly of FIG. 5 taken along line 8—8.

In assembly, referring to FIG. 3 and FIG. 4 in conjunction with FIG. 7 and FIG. 8, the conductive contacts 3 are respectively inserted through the passages 25 with curved contacting ends (not labeled) thereof exposed in the receiving space 20 for electrically connecting with corresponding terminals of a complementary connector (not shown). The retention sections 33 and the retention portions 34 interfere fit into corresponding passages 25 for securing the contacts 3 in the insulative housing 2. The tail sections 37 and the tail portions 32 are exposed beyond the rear face 22 of the housing 2. The blocks 6 are respectively inserted into the recesses 27 of the housing 2 for sealing the recesses 27 from outside. The spacer 4 is assembled to the groove 26 for preventing the melting material of the cover 7 from entering into the passages 25 when molding the cover 7 to the insulative housing 2. The protrusions 26 of the spacer 4 interfere fit into corresponding passages 25 for retaining the spacer 4 to the housing 2. The conductive wires 5 respectively electrically connect with the contacts 3 for transmitting different signals to the contacts 3. The insulated, conductive cores 52 of the first, the second and the third wires 5*a*, 5*b*, 5*c* are respectively soldered with the tail sections 37 and the tail portions 32 of the first, the second and the third contacts 3*a*, 3*b*, 3*c*.

An insulative cover 7 made of dielectric moldable material is overmolded on the rear end of the insulative housing 2, the tail sections 37 and the tail portions 32 of the contacts 3 and the insulated, conductive cores 52 of the wires 5. The insulative cover 7 functions as a strain relief to the wires 5 and protects the electrical connection between the contacts 3 and the wires 5. Since the spacer 4 and the blocks 6 respectively seals the rear end of the housing 2, the dielectric moldable material of the cover 7 has no possibility of entering into the housing 2 and further influencing the electrical transmission between the cable connector assembly 1 and the complementary connector. The pair of ribs 29 of the insulative housing 2 engages with the cover 7 for increasing the retaining force between the housing 2 and the cover 7.

The first contacts 3*a* of the cable connector assembly 1 are used for transmitting signal or power voltage to the complementary connector. The complementary connector has a detecting terminal (not shown) corresponding to the third detecting contact 3*c* and electrically connecting with a LED (not shown). When the third detecting contact 3*c* electrically engages with the detecting terminal of the complementary connector, the LED is on or off to indicate the engage status between the cable connector assembly 1 and the complementary connector. It is noted that since the cable connector assembly 1 and the complementary connector each has a contact functioning as a detecting signal, and the detecting terminal of the complementary connector electrically connects with the LED directly, electrical circuits arranged on a printed circuit board to which the complementary connector is mounted are, thus, simplified.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly adapted for engaging with a complementary connector, comprising:

an insulative housing comprising a mating face, a rear face opposite and parallel to the mating face, a pair of lateral faces disposed on opposite sides of the housing and extending between the mating face and the rear face, an L-shaped receiving space extending rearwardly from the mating face, and a plurality of passages protruding from the rear face toward the mating face and communicating with the receiving space, the insulative housing comprising a guiding member protruding outwardly from one lateral face;

a plurality of conductive contacts respectively received in the passages and comprising a first contact adapted for signal transmission to the complementary connector, a second contact and a third contact located beside the second contact and adapted for electrically connecting with a corresponding detecting terminal of the complementary connector to indicate engaging status between the cable connector assembly and the complementary connector;

a plurality of wires respectively electrically connecting with the conductive contacts; and an insulative cover partially enclosing the insulative housing, the conductive contacts and the wires.

2. The cable connector assembly as claimed in claim 1, wherein the second contact is a grounding contact.

3. The cable connector assembly as claimed in claim 1, wherein the first contact has a different structure from that of the third contact, and the second contact has the same structure as that of the third contact.

4. The cable connector assembly as claimed in claim 1, wherein the first contact is of a fork shape and comprises a tail section, three mating sections and three retention sections interconnecting the tail section and the three mating sections, and wherein the wires each comprise an insulated, conductive core soldered with corresponding tail sections.

5. The cable connector assembly as claimed in claim 4, wherein each of the second and the third contacts comprise a mating portion and a tail portion opposite to the mating portion and soldered with corresponding insulated, conductive cores of the wires.

6. The cable connector assembly as claimed in claim 1, further comprising a spacer, and wherein the insulative housing defines a groove in the rear face to receive the spacer therein for segregating the tail sections and the tail portions of the contacts.

7. The cable connector assembly as claimed in claim 1, wherein the cover is overmolded on the housing.

8. A cable connector assembly comprising:

an insulative housing defining a receiving space for receiving a complementary connector;

a plurality of passages extending in the housing along a front-to-back direction thereof;

a plurality of contacts disposed in the corresponding passages, respectively;

at least one recess formed in the housing and located at a different level from said passages for molding consideration;

an insulative spacer attached to a rear face of the housing and sealing the passages;

at least one block inserted into the recess and sealing said recess;

contact tails of said contacts extending rearwardly beyond the rear face and said spacer;

a plurality of wires mechanically and electrically connected to the corresponding contact tails, respectively; and an insulative cover over-molded upon a rear portion of the housing and front portions of said wires to seal connection between the contact tails and the wires without contamination from an over-molding procedure thereof.

9. A cable connector assembly comprising:

an insulative housing defining a plurality of passages therein;

a plurality of first contacts disposed in the corresponding passages, respectively;

a plurality of second contacts disposed in the corresponding passages, respectively, said second contacts being arranged in several groups and the second contacts in each of said groups sharing a same enlarged tail portion, a total amount of said second contacts in each of said groups being equal to a total number of said first contacts;

at least one first type wire connected to one of said first contacts;

at least one second type wire connected to one of others of said first contacts; and at least one third type wire connected to one tail portion of said second contacts; wherein the first type wire, the second type wire and the third type wire are different from one another.

* * * * *